US008362986B2

(12) United States Patent
Ishiguro et al.

(10) Patent No.: US 8,362,986 B2
(45) Date of Patent: Jan. 29, 2013

(54) LIGHT EMITTING APPARATUS, METHOD FOR DRIVING LIGHT EMITTING APPARATUS AND ELECTRONIC APPARATUS

(75) Inventors: Hideto Ishiguro, Shiojiri (JP); Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 357 days.

(21) Appl. No.: 12/783,097

(22) Filed: May 19, 2010

(65) Prior Publication Data

US 2010/0302228 A1 Dec. 2, 2010

(30) Foreign Application Priority Data

May 29, 2009 (JP) ..... 2009-130011

(51) Int. Cl.
*G09G 3/32* (2006.01)

(52) U.S. Cl. ..... 345/82; 345/76

(58) Field of Classification Search ..... 345/76, 345/77, 78, 690, 55, 82; 315/175
See application file for complete search history.

(56) References Cited

U.S. PATENT DOCUMENTS

2006/0170628 A1* 8/2006 Yamashita et al. ..... 345/76
2007/0126665 A1* 6/2007 Kimura ..... 345/76
2007/0268210 A1 11/2007 Uchino et al.
2008/0001545 A1* 1/2008 Uchino et al. ..... 315/175
2008/0198103 A1* 8/2008 Toyomura et al. ..... 345/77

FOREIGN PATENT DOCUMENTS

JP A 2007-310311 11/2007

* cited by examiner

*Primary Examiner* — Chanh Nguyen
*Assistant Examiner* — Pegeman Karimi
(74) *Attorney, Agent, or Firm* — Oliff & Berridge PLC

(57) ABSTRACT

A light emitting apparatus includes a pixel circuit, and a drive circuit which drives the pixel circuit. The pixel circuit has a light emitting device, a driving transistor connected in series to the light emitting device, a capacitive element arranged between a gate and a source of the driving transistor, a first switching device arranged between the gate of the driving transistor and a signal line corresponding to the pixel circuit, and a second switching device arranged between the source of the driving transistor and a reset line.

11 Claims, 8 Drawing Sheets

(A) INITIALIZATION PERIOD (B) COMPENSATION PERIOD (C) WRITING PERIOD (D) RESET PERIOD (E) LIGHT EMITTING PERIOD

LIGHT EMITTING APPARATUS, METHOD FOR DRIVING LIGHT EMITTING APPARATUS AND ELECTRONIC APPARATUS

BACKGROUND

1. Technical Field

The present invention relates to a light emitting apparatus, a method for driving the light emitting apparatus and an electronic apparatus.

2. Related Art

In recent years, there have been proposed light emitting apparatuses using a light emitting device such as an organic light emitting diode (hereinafter, referred to as "OLED") device including those called an organic EL (electroluminescent) device and a light emitting polymer device.

For example, JP-A-2007-310311 discloses a light emitting apparatus using a pixel circuit P0 shown in FIG. 14. As shown in FIG. 14, the pixel circuit P0 includes a driving transistor 3B and an OLED device 3D which are arranged in series with each other, a switching device 3A arranged between a gate of the driving transistor 3B and a data line DTL101, and a capacitive element 3C. As shown in FIG. 14, the OLED device 3D is accompanied by a capacitance 31.

Next, an action of the pixel circuit P0 is described. In a first period, when a potential of the data line DTL101 is set to a reference potential V0, and the switching device 3A is set to be turned on, a gate potential of the driving transistor 3B is reset to the reference potential V0. In a second period, a power potential supplied to a power line DSL101 is set to be a potential Vcc_L much lower than the reference potential V0. The potential Vcc_L is set so that a voltage between the gate and a source of the driving transistor 3B is higher than the threshold voltage of the driving transistor 3B. This makes the driving transistor 3B be turned on, and a source potential of the driving transistor 3B set to be Vcc_L. In a third period, when the power potential supplied to the power line DSL101 is set to be a high potential Vcc_H, the source potential of the driving transistor 3B starts rising, the voltage between the gate and the source of the driving transistor 3B asymptotically comes close to the threshold voltage of the driving transistor 3B. In a fourth period, when the potential of the data line DTL101 is set to be a data potential Vin corresponding to designated gradation for the pixel circuit P0, the driving transistor 3B is turned on, and a current between a drain and the source flows into the capacitance 3I accompanying to the OLED device 3D. Therefore, the source potential of the driving transistor 3B rises, and a mobility compensation action by negative feedback is performed. That is, the voltage between the gate and the source of the driving transistor 3B (voltage between both ends of the capacitive element 3C) is set to a value in which the data potential Vin and properties of the driving transistor 3B (threshold voltage and mobility) are reflected. In a fifth period (light emitting period), when the switching device 3A is set to be turned off, the gate of the driving transistor 3B is made electrically floating. When a current corresponding to the voltage between both ends of the capacitive element 3C flows in the driving transistor 3B, the source potential of the driving transistor 3B rises, and the gate potential of the driving transistor 3B rises in conjunction with the source potential (bootstrap action). The voltage between both ends of the capacitive element 3C is kept to be the value set in the fourth period. Then, when the source potential of the driving transistor 3B exceeds a light emitting threshold value, the OLED device 3D emits light.

Here, a time length t from a starting point of the light emitting period until the OLED device 3D starts emitting light is determined depending on the source potential of the driving transistor 3B at the starting point of the light emitting period and the current flowing in the driving transistor 3B. More specifically, assuming a difference between the source potential of the driving transistor 3B at the starting point of the light emitting period and the source potential of the driving transistor 3B when the OLED device 3D starts emitting light is ΔVb, the current flowing in the driving transistor 3B is Idata, and a capacitance value of the capacitive element 3I is Coled, the above-described time length t can be represented by formula (I) shown below.

$$t=(Coled\times\Delta Vb)/I\text{data} \quad (1)$$

In JP-A-2007-310311 described above, the current Idata flowing in the driving transistor 3B can be set to a value independent of the properties of the driving transistor (threshold voltage and mobility) by the compensation action in the period previous to the light emitting period. However, the source potential of the driving transistor 3B is made to be a value corresponding to the properties of the driving transistor 3B, and the value is difficult to accurately grasp. Unless the source potential value of a driving transistor TDR at the starting point of the light emitting period can be accurately grasped, ΔVb in the above formula (1) cannot be accurately grasped, and it is difficult to set highly precisely the time length t from the starting point of the light emitting period until the OLED device 3D starts emitting light. Gradation of a pixel recognized by an observer is obtained by integrating a light emission luminance of the OLED device 3D by time in a period while the OLED device 3D actually emits light. However, if the above time length t cannot be set highly precisely, the time length while the OLED device 3D actually emits light in the light emitting period cannot highly precisely be set and the time integral value of the light emission luminance of the OLED device 3D is difficult to set highly precisely. This disadvantageously has made it difficult to set the gradation of the pixel recognized by the observer to a desired value.

SUMMARY

An advantage of some aspects of the invention is that a gradation of a pixel recognized by an observer can be highly precisely set to a desired value.

A light emitting apparatus according to an aspect of the invention includes a pixel circuit, and a drive circuit which drives the pixel circuit. The pixel circuit has a light emitting device, a driving transistor connected in series to the light emitting device, a capacitive element arranged between a gate and a source of the driving transistor, a first switching device arranged between the gate of the driving transistor and a signal line, and a second switching device arranged between the source of the driving transistor and a reset line. The drive circuit, for a first period (also including, for example, besides a writing period PWRT shown in FIG. 4, a combined period of a compensation period PCP and the writing period PWRT) sets the first switching device to be turned on and sets a potential to be supplied to the signal line to a data potential corresponding to designated gradation of the pixel circuit to flow a current according to the data potential in the driving transistor and set a voltage between both ends of the capacitive element to a value in which the data potential and properties of the driving transistor (for example, at least one of the threshold voltage and the mobility of the driving transistor) are reflected, for a second period after the first period (for example, a reset period Pr shown in FIG. 4) sets the first switching device to be turned off and sets the second switching device to be turned on to set a source potential of the driving transistor to a reset potential supplied to the reset line, and for a third period after the second period (for example, a light emitting period PEL shown in FIG. 4) sets the second switching device to be turned off to vary the source potential of the driving transistor (a potential of a connecting point between the driving transistor and the light emitting device) so that the light emitting device emits light. For example, if the driving transistor is an N-channel type transistor, the drive circuit sets the second switching device to be turned off for the third period to raise the source potential of the driving transistor and allow the light emitting device to emit light. On the other hand, if the driving transistor is a P-channel type transistor, the drive circuit sets the second switching device to be turned off for the third period to lower the source potential of the driving transistor and allow the light emitting device to emit light.

More specifically, the driving transistor and the light emitting device are arranged between a first power line supplied with a first potential and a second power line supplied with a second potential, one of electrodes of the light emitting device is connected to the source of the driving transistor and the other is connected to the second power line, and a potential difference between the source potential of the driving transistor and the second potential for the first period and the second period is set so as to fall below a light emitting threshold voltage of the light emitting device. For example, if the driving transistor is an N-channel type transistor, the first potential is set to a potential higher than the second potential, and if the driving transistor is a P-channel type transistor, the second potential is set to a potential higher than the first potential.

According to an aspect of the invention, for the second period, the source potential of the driving transistor is set to a reset potential independently of the threshold and the mobility of the driving transistor. That is, the source potential of the driving transistor at a starting point of the third period after the second period (light emitting period) is set to the reset potential independently of the properties of the driving transistor. Then, the reset potential is set to a predetermined target value to enable the time length t of the above-described formula (1) to be set highly precisely. This makes it possible to set highly precisely a time length while the light emitting device actually emits light in the light emitting period, and a time integral value of the light emission luminance of the light emitting device can be set highly precisely. That is, the gradation of the pixel recognized by the observer advantageously may be set highly precisely to a desired value.

In a light emitting apparatus according to an aspect of the invention, the pixel circuit further includes a third switching device disposed between a node and an initialization line, the node being disposed between the gate of the driving transistor and the first switching device, and a light emitting control transistor arranged between a high-side power line and a low-side power line. The drive circuit, for an initialization period before the first period, sets the light emitting control transistor and the first switching device to be turned off, and sets the second switching device and the third switching device to be turned on so as to initialize a voltage between the gate and the source of the driving transistor; for a compensation period in the first period, sets the first switching device and the second switching device to be turned off, and sets the third switching device and the light emitting control transistor to be turned on so as to perform a compensation action which makes the voltage between the gate and the source of the driving transistor asymptotically come close to a threshold voltage; and for a writing period after the compensation period in the first period, sets the first switching device and the light emitting control transistor to be turned on, sets the second switching device and the third switching device to be turned off, and sets a potential to be supplied to the signal line to the data potential. The drive circuit sets the light emitting control transistor to be turned off for the second period, and sets the light emitting control transistor to be turned on for the third period. For the third period, the light emitting control transistor is set to be turned off; thus, a current does not flow in the driving transistor. Therefore, the current may be advantageously prevented from flowing in the driving transistor compared with the aspect where the light emitting control transistor is kept in the on state also for the third period.

In a light emitting apparatus according to an aspect of the invention, the drive circuit varies the data potential with time so that a time change rate of the data potential at a time when the first switching device is made to be turned off to stop the supply of the data potential to the driving transistor becomes a time change rate corresponding to the designated gradation. Note that the time change rate of a potential means a rate with which the potential varies with time elapsed, and is synonymous with a gradient of the potential for the time axis and a time differential value of the potential.

According to this aspect, when the gate of the driving transistor is supplied with the data potential, a current corresponding to the time change rate of the data potential (a current not depending on the threshold voltage and the mobility of the driving transistor) flows in the driving transistor. The voltage between both ends of the capacitive element is set to such a voltage where the current corresponding to the time change rate of the data potential at the time when the supply of the data potential to the driving transistor is stopped is made flow in the driving transistor. More specifically, the voltage between both ends of the capacitive element is set so that a current corresponding to a product of the time change rate of the data potential at a time of stopping the supply of the data potential to the gate of the driving transistor and a capacitance value of a capacitance pertaining to the light emitting device flows in the driving transistor. The time change rate at the time of stopping the supply of the data potential is set variable depending on the designated gradation of the pixel circuit. Therefore, a driving current supplied to the light emitting device depending on the voltage between both ends of the capacitive element is set to a current amount corresponding to the designated gradation (a current amount not depending on the threshold voltage and the mobility of the driving transistor).

A light emitting apparatus according to the aspects of the invention may be used for various electronic apparatuses. An example of the electronic apparatus typically includes an apparatus using the light emitting apparatus as a display device. An electronic apparatus according to the aspects of the invention may include a personal computer and a cellular phone by way of example. However, the light emitting apparatus according to the aspects of the invention is not limited to the application to the display of an image. For example, the light emitting apparatus of the aspects of the invention may also be applied to an exposure device (optical head) which forms a latent image on an image carrier such as a photosensitive drum by irradiating a light beam.

The invention may be applicable for a method for driving a light emitting apparatus. In the light emitting apparatus having a pixel circuit which has a light emitting device, a driving transistor connected in series to the light emitting device, and a capacitive element arranged between a gate and a source of the driving transistor, the method includes: for a first period, setting a voltage between both ends of the capacitive element to a value in which a data potential and properties of the driving transistor are reflected by supplying the data potential corresponding to designated gradation of the pixel circuit to the gate of the driving transistor to flow a current corresponding to the data potential in the driving transistor; for a second period after the first period, setting a source potential of the driving transistor to a reset potential; and for a third period after the second period, varying the source potential of the driving transistor so that the light emitting device emits light.

According to an aspect of the invention for a driving method of a light emitting apparatus, it is preferable for the data potential to be varied with time so that a time change rate of the data potential at a time when a first switching device is made to be turned off to stop the supply of the data potential to the driving transistor becomes a time change rate corresponding to the designated gradation.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: Principle of Driving

Figure 1:
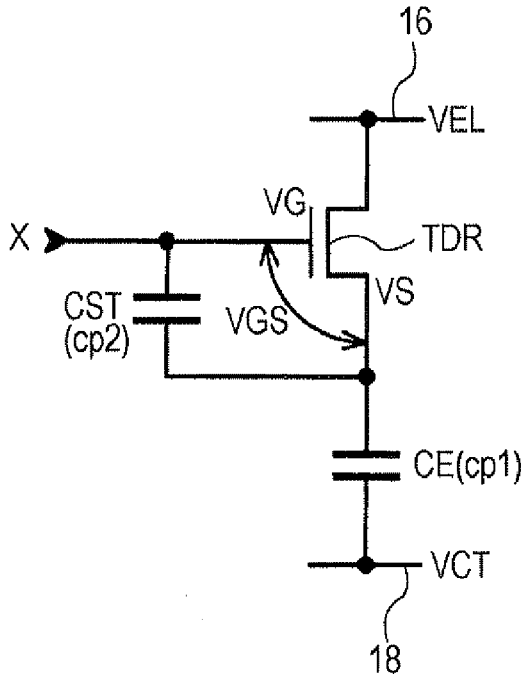
FIG. 1 is a circuit diagram illustrating a principle of driving a pixel circuit.

Previously to describe a specific embodiment of the invention, a principle used for driving a pixel circuit is described. As shown in FIG. 1, assumed is a circuit in which a driving transistor TDR of N-channel type and a capacitance CE (capacitance value cp1) are arranged in series in a route connecting a feed line 16 and a feed line 18.

The feed line 16 is supplied with a potential VEL and the feed line 18 is supplied with a potential VCT (VCT<VEL). A drain of the driving transistor TDR is connected to the feed line 16, and the capacitance CE is disposed between a source of the driving transistor TDR and the feed line 18. A retention capacitance CST (capacitance value cp2) is disposed between the source and a gate of the driving transistor TDR. Therefore, a voltage VGS of a difference between a gate potential VG and a source potential VS of the driving transistor TDR (VGS=VG−VS) is applied between both ends of the retention capacitance CST.

Figure 2:
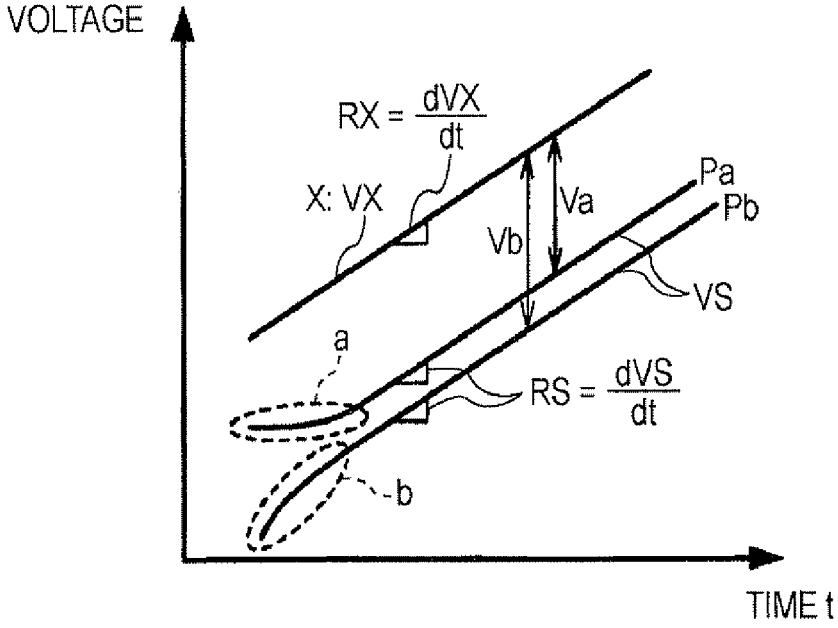
FIG. 2 is a graph illustrating the principle of driving the pixel circuit.

The gate of the driving transistor TDR is supplied with a drive signal X. A potential VX of the drive signal X varies with time as shown in FIG. 2. In FIG. 2, a case is exemplarily shown where the potential VX linearly rises at a predetermined time change rate RX(RX=dVX/dt). Further, in FIG. 2, the temporal change of the source potential VS is together represented in the cases where the electrical properties of the driving transistor TDR (e.g., mobility and threshold voltage) is a property Pa and a property Pb, respectively.

When the gate potential VG (potential VX) of the driving transistor TDR rises by the drive signal X supplied, and the voltage VGS between the gate and the source of the driving transistor TDR exceeds a threshold voltage VTH of the driving transistor TDR, a current IDS flows between the drain and the source of the driving transistor TDR. The current IDS is represented by formula (2) below. μ in formula (2) represents the mobility of the driving transistor TDR. W/L is a relative ratio of a channel width W to a channel length L of the driving transistor TDR. Cox represents a capacitance value per unit area of a gate insulator film of the driving transistor TDR.

$$IDS=\tfrac{1}{2}\cdot\mu\cdot W/L\cdot Cox\cdot(VGS-VTH)^2 \tag{2}$$

Meanwhile, when the current IDS flows in the driving transistor TDR, the capacitance CE and the retention capacitance CST are charged with electrical charge. Thus, as shown in FIG. 2, the source potential VS of the driving transistor TDR varies at a time change rate RS (RS=dVS/dt) with time. Between the current IDS and the source potential VS of the driving transistor TDR, a relationship of formula (3) below is established.

$$\begin{aligned} IDS &= \frac{dQ}{dt} \\ &= cp2\cdot\left(\frac{dVS}{dt}-\frac{dVX}{dt}\right)+cp1\cdot\frac{dVS}{dt} \end{aligned} \tag{3}$$

In a case where, as is shown in FIG. 2 with portion a, the time change rate (that is, a gradient of the potential VS with respect to the time t) RS of the source potential VS of the driving transistor TDR falls below the time change rate RX of the potential VX of the drive signal X, the voltage VGS between the gate and the source of the driving transistor TDR increases with time. As shown by formula (2), when the voltage VGS increases, the current IDS increases. Then, as is seen from formula (3), when the current IDS increases, the time change rate RS also increases. That is, when the time change rate RS falls below the time change rate RX, the time change rate RS increases.

On the other hand, in a case where, as is shown in FIG. 2 with portion b, the time change rate RX of the potential VX of the drive signal X falls below the time change rate RS of the source potential VS, the voltage VGS between the gate and the source decreases with time. Thus, as is seen from formula (2), the current IDS decreases. When the current IDS decreases, the time change rate RS decreases. That is, when the time change rate RS exceeds the time change rate RX, the time change rate RS decreases.

As described above, the time change rate RS of the source potential VS of the driving transistor TDR, regardless of the properties of the driving transistor TDR (that is, it may be either the property Pa or the property Pb), comes close to time change rate RX of the potential VX of the drive signal X with time, and finally reaches the time change rate RX. A state where the time change rate RS matches the time change rate RX (hereinafter, referred to as an "equilibrium state") may be said to be a state where the increase in the voltage VGS owing to the rise of the potential VX of the drive signal X is equilibrated with the decrease in the voltage VGS owing to the charge by the current IDS.

In the equilibrium state, since the time change rate RS and the time change rate RX coincide with each other (RS=dVS/dt=RX=dVX/dt), formula (3) is transformed into formula (4) below. That is, the current IDS flowing into the driving transistor TDR is proportional to the time change rate RX of the potential VX of the drive signal X. In further detail, the current IDS is determined depending on only the capacitance value cp1 of the capacitance CE and the time change rate RX of the potential VX, and not depending on the mobility μ and the threshold voltage VTH of the driving transistor TDR.

$$\begin{aligned} IDS &= cp2\cdot\left(\frac{dVS}{dt}-\frac{dVX}{dt}\right)+cp1\cdot\frac{dVS}{dt} \\ &= cp2\cdot\left(\frac{dVX}{dt}-\frac{dVX}{dt}\right)+cp1\cdot\frac{dVX}{dt} \\ &= cp1\cdot RX \end{aligned} \tag{4}$$

The voltage VGS between the gate and the source of the driving transistor TDR is automatically set depending on the mobility μ and the threshold voltage VTH thereof so as to become a voltage which is required for the current IDS of formula (4) not depending on the mobility μ and the threshold voltage VTH to flow in the driving transistor TDR (that is, the voltage VGS satisfying the relationship of formula (2) with respect to the current IDS of formula (4)). For example, if the property of the driving transistor TDR is the property Pa of FIG. 2, the voltage VGS is set to a voltage Va, and if the property of the driving transistor TDR is the property Pb of FIG. 2, the voltage VGS is set to a voltage Vb. In the equilibrium state, in the case of either the property Pa or the property Pb, the common current IDS according only to the capacitance value cp1 and the time change rate RX flows in the driving transistor TDR.

The voltage VGS between the gate and the source set by the above-described method is retained in the retention capacitance CST. Therefore, the driving transistor TDR may be continuously flown by the current IDS even after the supply of the drive signal X (potential VX) is stopped. In the embodiment exemplified below, the current IDS is used as a current (hereinafter, referred to as "driving current") IDR for driving the light emitting device. As described with reference to formula (4), since the current IDS does not depend on the properties of the driving transistor TDR (mobility μ and threshold voltage VTH), a variation of the driving current IDR caused by the properties of the driving transistor TDR (and further variation of luminance of the light emitting device) can be compensated. On the other hand, the driving current IDR (current IDS) is determined depending on the time change rate RX of the potential VX of the drive signal X, therefore, controlling the time change rate RX of the drive signal X allows a current amount of the driving current IDR (and further the luminance of the light emitting device) to be set variable.

B: Configuration and Action of Light Emitting Apparatus

Figure 3:
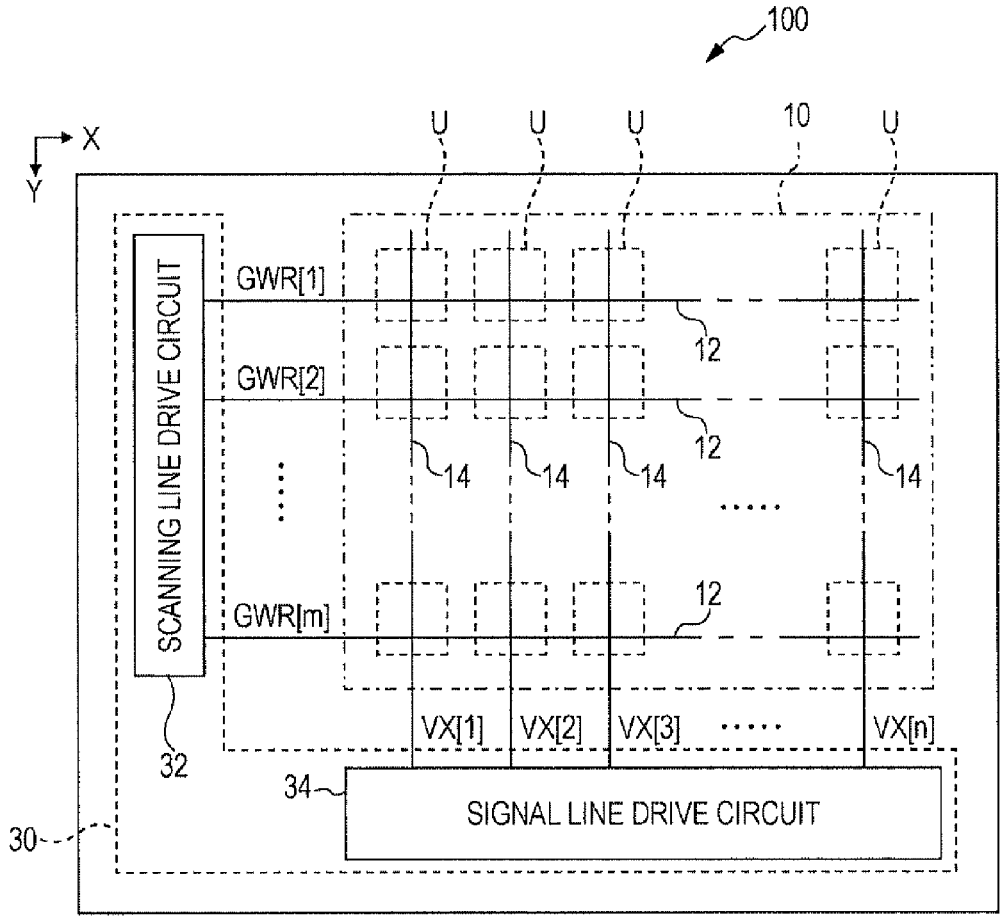
FIG. 3 is a block diagram of a light emitting apparatus according to an embodiment of the invention.

FIG. 3 is a block diagram of the light emitting apparatus according to the embodiment of the invention. A light emitting apparatus 100 is mounted in an electronic apparatus as a display device for displaying an image. As shown in FIG. 3, the light emitting apparatus 100 includes an element part 10 having a plurality of pixel circuits U arranged therein and a drive circuit 30 which drives each of the pixel circuits U. The drive circuit 30 is configured to include a scanning line drive circuit 32 and a signal line drive circuit 34. The drive circuit 30 is implemented decentrally in a plurality of integrated circuits, for example. However, at least a part of the drive circuit 30 may be constituted by a thin film transistor formed on a substrate with the pixel circuits U.

The element part 10 has formed thereon m scanning lines 12 extending in an X-direction and n signal lines 14 intersecting with the X-direction and extending in a Y-direction (m and n are natural numbers). The plurality of pixel circuits U are arranged on respective intersections of the scanning lines 12 and the signal lines 14 in a matrix form of m rows×n columns.

Figure 4:
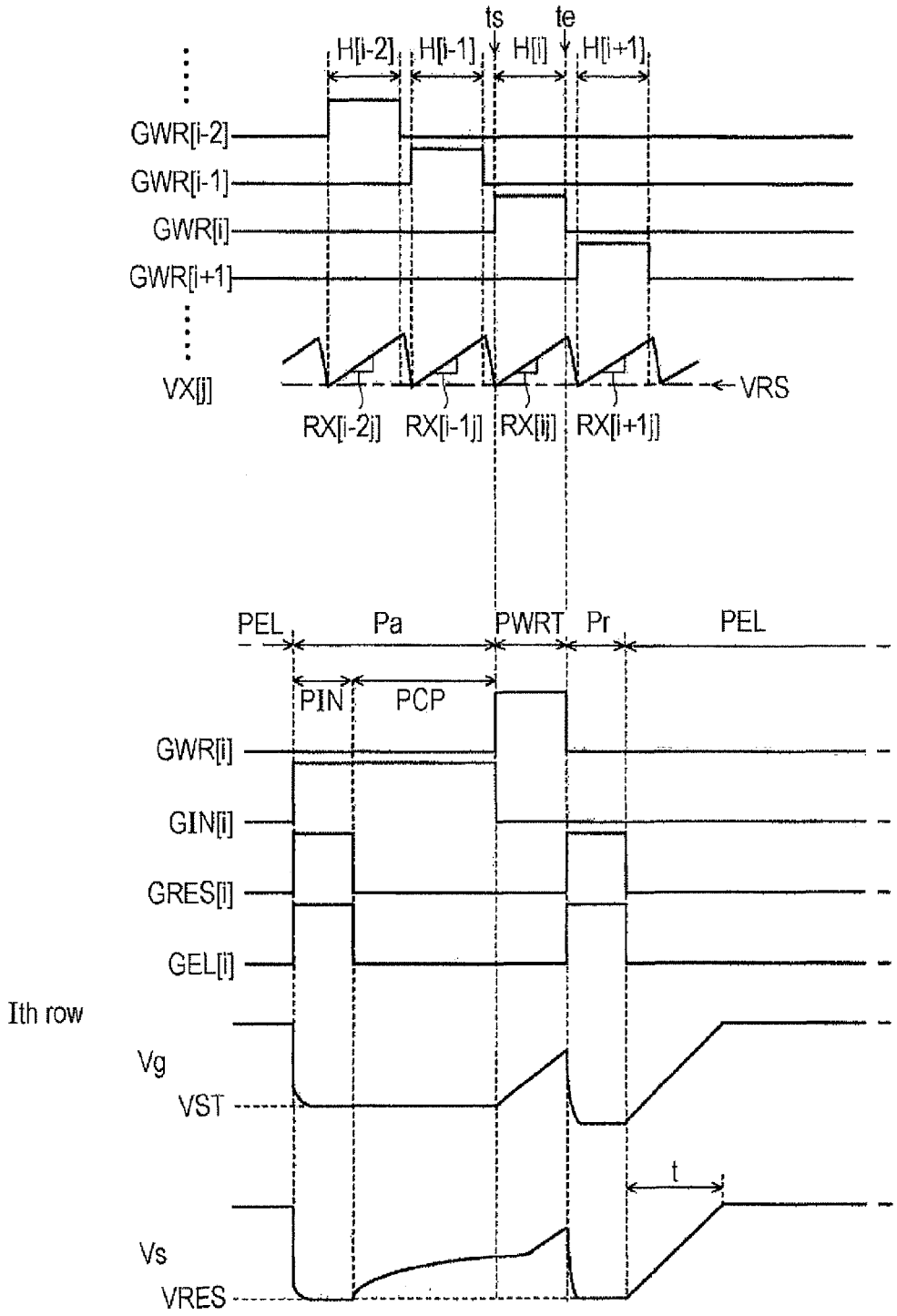
FIG. 4 is a timing chart showing an action of the light emitting apparatus.

The scanning line drive circuit 32 is a circuit for selecting the plurality of pixel circuits U in a row unit. As shown in FIG. 4, the scanning line drive circuit 32 sets sequentially scanning signals GWR[1] to GWR[m] to an active level (high level) respectively for m unit periods H (H([1] to H[m]) in a vertical scanning period to sequentially select the scanning lines 12 (a set of n pixel circuits U in each row). In the following, a period while each of the scanning signals GWR[1] to GWR[m] is made high level is represented as a "writing period PWRT."

The signal line drive circuit 34 shown in FIG. 3 generates data potentials VX[1] to VX[n] respectively corresponding to the designated gradation of the pixel circuits U of one row(n in number) selected by the scanning line drive circuit 32 for each writing period PWRT, and outputs to the respective signal lines 14. For example, with attention paid to the signal line 14 of a jth column (j is 1 to n), as shown in FIG. 4, the signal line drive circuit 34 generates a data potential VX[j] varying with time with a period of the unit period H, and outputs to the signal line 14 of the jth column. The data potential VX[j] is set to a reference potential VRS at a starting point is in the unit period H, and linearly rises from the starting point is to an ending point to in the unit period H at the time change rate RX (RX=dVX/dt). That is, the data potential VX[j] is a voltage signal with a period of the unit period H having a ramp waveform (sawtooth waveform). For the writing period PWRT (unit period H[i]) while the scanning line 12 of an ith row (i is 1 to m) is selected, the time change rate RX[i, j] of the data potential VX[j] supplied to the signal line 14 of the jth column is set to be variable depending on the designated gradation of the pixel circuit U positioned at the ith row and the jth column. In further detail, the higher the designated gradation of the pixel circuit U, the larger a number is set to the time change rate RX[i, j] of the data potential VX[j]. That is, the higher the designated gradation of the pixel circuit U, the steeper the gradient of the data potential VX[j] with respect to a time axis. The same goes for the data potentials VX output to other signal lines 14.

Figure 5:
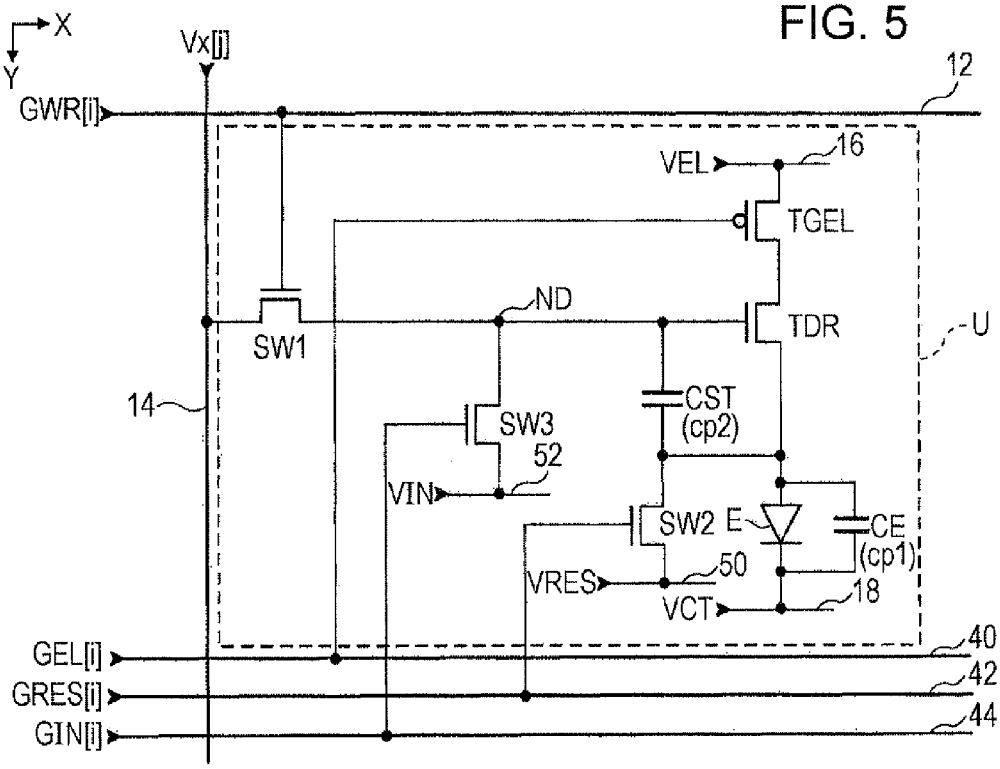
FIG. 5 is a circuit diagram of the pixel circuit.

FIG. 5 is a circuit diagram of the pixel circuit U. In FIG. 5, one pixel circuit U positioned at the ith row and the jth column only is representatively shown. As shown in FIG. 5, the element part 10 is provided with a first control line 40, a second control line 42 and a third control line 44 each extending in the X-direction in one-to-one correspondence to each of the m scanning lines 12. The first control line 40, the second control line 42 and the third control line 44 are each supplied with a predetermined signal from the drive circuit 30 (e.g., scanning line drive circuit 32). More specifically, the first control line 40 is supplied with a light emitting control signal GEL[i], the second control line 42 is supplied with a reset signal GRES[i], and the third control line 44 is supplied with an initialization signal GIN[i].

As shown in FIG. 5, the pixel circuit U is configured to include a light emitting device E, the driving transistor TDR, a light emitting control transistor TGEL, the capacitive element CST, a first switching device SW1, a second switching device SW2 and a third switching device SW3. The light emitting device E, the driving transistor TDR and the light emitting control transistor TGEL are arranged in series in a route connecting the feed line 16 supplied with a high-side potential VEL and the feed line 18 supplied with a low-side potential VCT (<VEL). The light emitting device E is an organic EL device having a light emitting layer of organic EL (electroluminescence) material interposed between a positive electrode and a negative electrode thereof opposite to each other. As shown in FIG. 5, the light emitting device E is accompanied with the capacitance CE (capacitance value cp1) of FIG. 1.

The light emitting control transistor TGEL is a P-channel type transistor (e.g., thin film transistor) and has a source thereof connected to the feed line 16 and a drain thereof connected to the driving transistor TDR. A gate of the light emitting control transistor TGEL is connected to the first control line 40. The driving transistor TDR is an N-channel type transistor and has a drain thereof connected to the light emitting control transistor TGEL and a source thereof connected to the positive electrode of the light emitting device E. The capacitive element CST (capacitance value cp2) is disposed between the source of the driving transistor TDR (or, a route between the driving transistor TDR and the light emitting device E) and a gate of the driving transistor TDR.

The first switching device SW1 is an N-channel type transistor and arranged between the signal line 14 and the gate of the driving transistor TDR. A gate of the first switching device SW1 is connected to the scanning line 12.

The second switching device SW2 is an N-channel type transistor and arranged between a reset line 50 supplied with a reset potential VRES and the source of the driving transistor TDR. A gate of the second switching device SW2 is connected to the second control line 42.

The third switching device SW3 is an N-channel type transistor and arranged between a node ND disposed between the driving transistor TDR and the first switching device SW1, and an initialization line 52 supplied with an initialization potential VST. A gate of the third switching device SW3 is connected to the third control line 44.

Next, with reference to FIG. 4, a description is given of a waveform of each signal used in the light emitting apparatus 100. As shown in FIG. 4, the initialization signal GIN[i] is a signal which is set to the active level (high level) for a period Pa (hereinafter, referred to as "action period") immediately before the writing period PWRT while the scanning signal GWR[i] is set to the high level, and to a non-active level (low level) for other periods. As shown in FIG. 4, the action period Pa is divided into an initialization period PIN and a compensation period PCP immediately after the period PIN. The initialization period PIN is a period for initializing the voltage between the gate and the source of the driving transistor TDR, and the compensation period PCP is a period for making the voltage between the gate and the source of the driving transistor TDR asymptotically come close to the threshold voltage VTH of the driving transistor TDR.

The reset signal GRES[i] is a signal which is set to the active level (high level) for the initialization period PIN in the action period Pa and a period Pr from the ending point of the writing period PWRT until a point while a predetermined time length elapses (hereinafter, referred to as "reset period"), and to the non-active level (low level) for other periods. The reset period Pr is a period for resetting the source potential of the driving transistor TDR.

The light emitting control signal GEL[i] is a signal which is set to the active level (in the embodiment, low level) for a period PEL from after the end of the reset period Pr until before the start of the action period Pa when the initialization signal GIN[i] becomes the high level (hereinafter, referred to as "light emitting period"), the compensation period PCP and the writing period PWRT, and to the non-active level (in the embodiment, high level) for other periods.

Next, a description is given of a specific action (driving method) of the pixel circuit U. In the following description, the action of the pixel circuit U at the ith row and the jth column is described with the action being divided into the cases of the initialization period PIN, the compensation period PCP, the writing period PWRT, the reset period Pr, and the light emitting period PEL. The same goes for the actions of other pixel circuits U.

a: Initialization Period PIN

Figure 6:
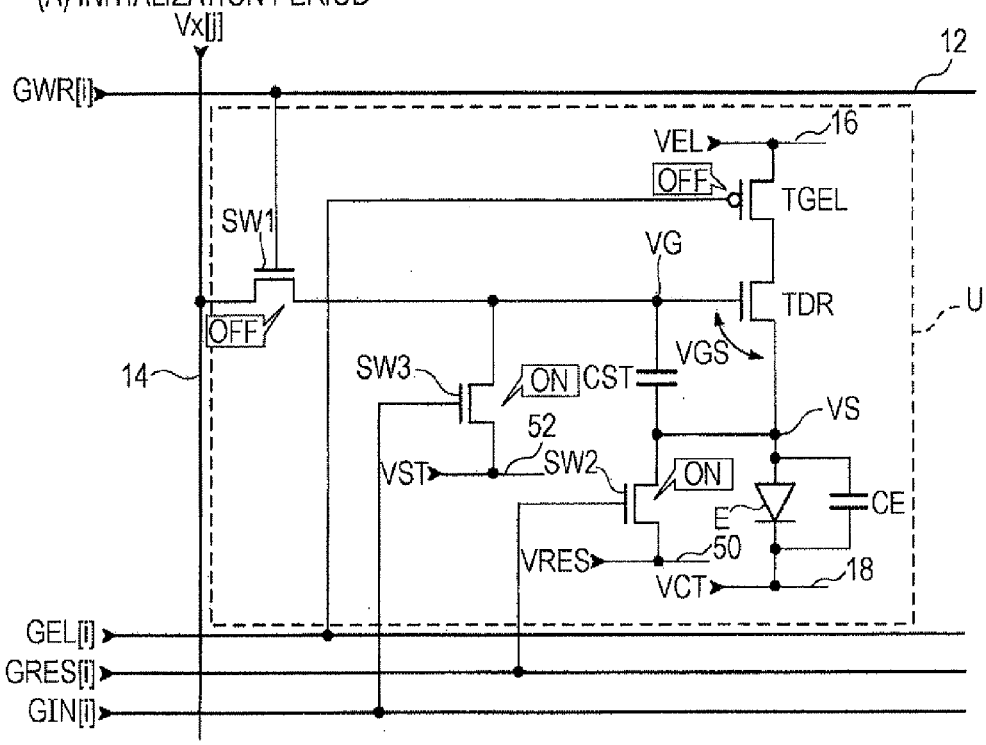
FIG. 6 is a diagram showing an action of the pixel circuit in an initialization period.

As shown in FIG. 4, the drive circuit 30 (e.g., scanning line drive circuit 32) sets the initialization signal GIN[i], the reset signal GRES[i] and the light emitting control signal GEL[i] to the high level, and sets the scanning signal GWR[i] to the low level. Therefore, as shown in FIG. 6, the second switching device SW2 and the third switching device SW3 are made to be turned on, whereas the first switching device SW1 and the light emitting control transistor TGEL are made to be turned off.

The source of the driving transistor TDR is conducted via the second switching device SW2 to the reset line 50; thus, the source potential VS of the driving transistor TDR is set to the reset potential VRES supplied to the reset line 50. Additionally, the gate of the driving transistor TDR is conducted via the third switching device SW3 to the initialization line 52; thus, the gate potential VG of the driving transistor TDR is set to the initialization potential VST supplied to the initialization line 52. Therefore, the voltage VGS between the gate and the source of the driving transistor TDR is set (initialized) to |VIN−VRES|. In the embodiment, a difference |VIN−VRES| between the initialization potential VST and the reset potential VRES is set to a value so as to exceed the threshold voltage VTH of the driving transistor TDR. Further, the reset potential VRES is set to a value so that a potential difference between the reset potential VRES and the low-side potential VCT supplied to the feed line 18 (that is, the voltage between both ends of the capacitance CE) falls below the light emitting threshold voltage of the light emitting device E.

b: Compensation Period PCP

Figure 7:
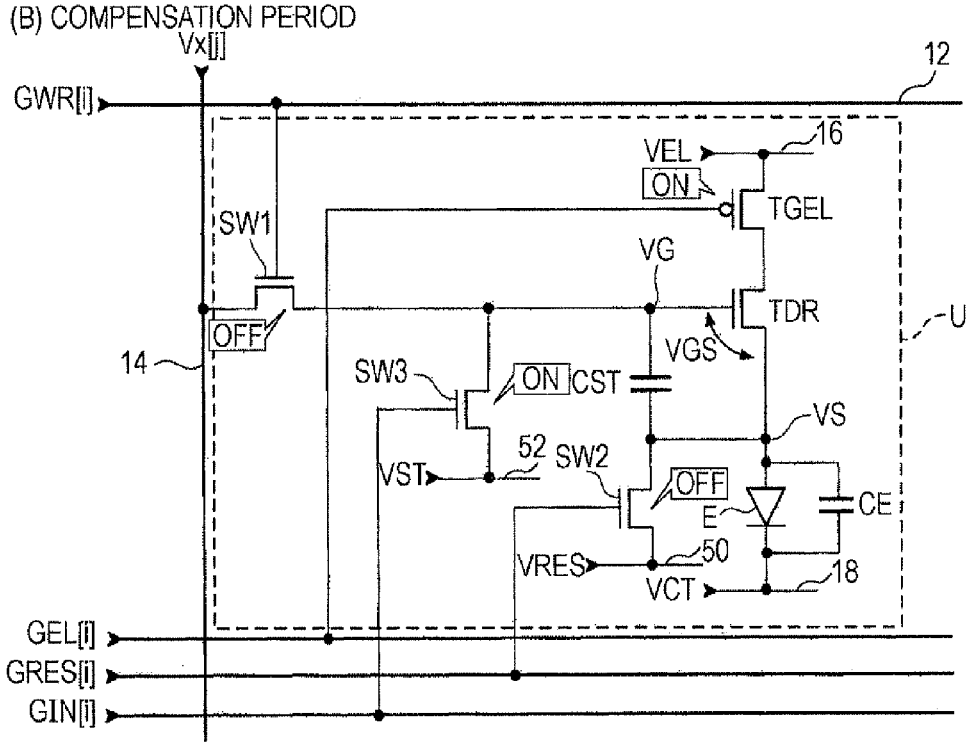
FIG. 7 is a diagram showing an action of the pixel circuit in a compensation period.

As shown in FIG. 4, when the compensation period PCP starts, the drive circuit 30 sets the reset signal GRES[i] and the light emitting control signal GEL [i] to the low level. Other signals are kept at the same level as in the initialization period PIN. Therefore, as shown in FIG. 7, the second switching device SW2 is transitionally turned off, whereas the light emitting control transistor TGEL is transitionally turned on. Consequently, a current from the feed line 16 flows via the light emitting control transistor TGEL into the driving transistor TDR to allow the source potential VS of the driving transistor TDR to start rising. At this time, since the gate potential VG of the driving transistor TDR is kept at the initialization potential VST, the voltage VGS between the gate and the source of the driving transistor TDR gradually decreases, and asymptotically comes close to the threshold voltage VTH of the driving transistor TDR. That is, for the compensation period PCP, a compensation action is performed which makes the voltage VGS between the gate and the source of the driving transistor TDR asymptotically come close to the threshold voltage VTH of the driving transistor TDR.

The voltage between the gate and the source of the driving transistor TDR becomes approximately equal to the threshold voltage VTH of the driving transistor TDR at the ending point of the compensation period PCP; thus, the source potential VS of the driving transistor TDR is set to a potential VST-VTH which is lower than the potential VST (gate potential VG) by the threshold voltage VTH. In the embodiment, the potential difference between the potential VST-VTH and the low-side potential VCT (voltage between both ends of the capacitance CE) is set so as to fall below the light emitting threshold voltage of the light emitting device E.

c: Writing Period PWRT

Figure 8:
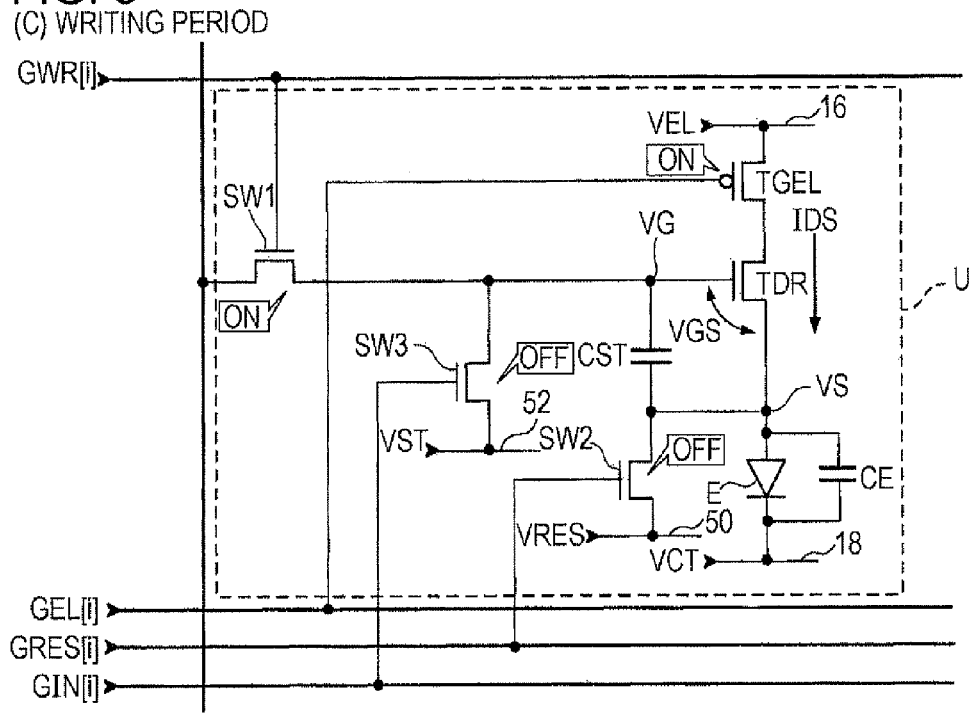
FIG. 8 is a diagram showing an action of the pixel circuit in a writing period.

As shown in FIG. 4, when the writing period PWRT starts, the drive circuit 30 sets the scanning signal GWR[i] to the high level, whereas the initialization signal GIN[i] to the low level. Other signals are kept at the same level as in the compensation period PCP. Therefore, as shown in FIG. 8, the first switching device SW1 is transitionally turned on, whereas the third switching device SW3 is transitionally turned off. Consequently, the gate of the driving transistor TDR is conducted to the signal line 14. This allows the gate of the driving transistor TDR to be supplied with the data potential VX[j], and the gate potential VG of the driving transistor TDR to rise with time at the time change rate RX[i,j] corresponding to the designated gradation of the pixel circuit U. On the other hand, the current IDS corresponding to the gate potential VG flows between the drain and the source of the driving transistor TDR to allow the source potential VS to rise with time. Then, when the equilibrium state is achieved in which the time change rate RS (RS=dVS/dt) of the source potential VS matches the time change rate RX[i,j] of the data potential VX[j], the current IDS which depends on only the capacitance value cp1 of the capacitance CE pertaining to the light emitting device E and the time change rate RX[i,j] flows in the driving transistor TDR until the ending point of the writing period PWRT.

When the scanning signal GWR[i] transits to the low level at the ending point of the writing period PWRT, the first switching device SW1 is made to be turned off to stop the supply of the data potential VX[j] to the gate of the driving transistor TDR. The capacitive element CST holds the voltage VSET corresponding to the current IDS flowing in the driving transistor TDR on stopping the supply of the data potential VX[j]. The voltage VSET is the voltage VGS between the gate and the source which is necessary in order to flow the current IDS of formula (4) determined depending on the capacitance value cp1 of the capacitance CE and the time change rate RX[i,j] into the driving transistor TDR, and is automatically set depending on the properties such as the mobility μ and the threshold voltage VTH of the driving transistor TDR (refer to "A: Principle of Driving"). Specifically, the voltage VSET between both ends of the capacitive element CST is set to a value in which the data potential VX[j] and the properties of the driving transistor TDR are reflected. Note that the source potential VS of the driving transistor TDR at the ending point of the writing period PWRT is set so that the potential difference between the source potential VS and the low-side potential VCT (that is, the voltage between both ends of the capacitance CE) falls below the light emitting threshold voltage of the light emitting device E.

d: Reset Period Pr

Figure 9:
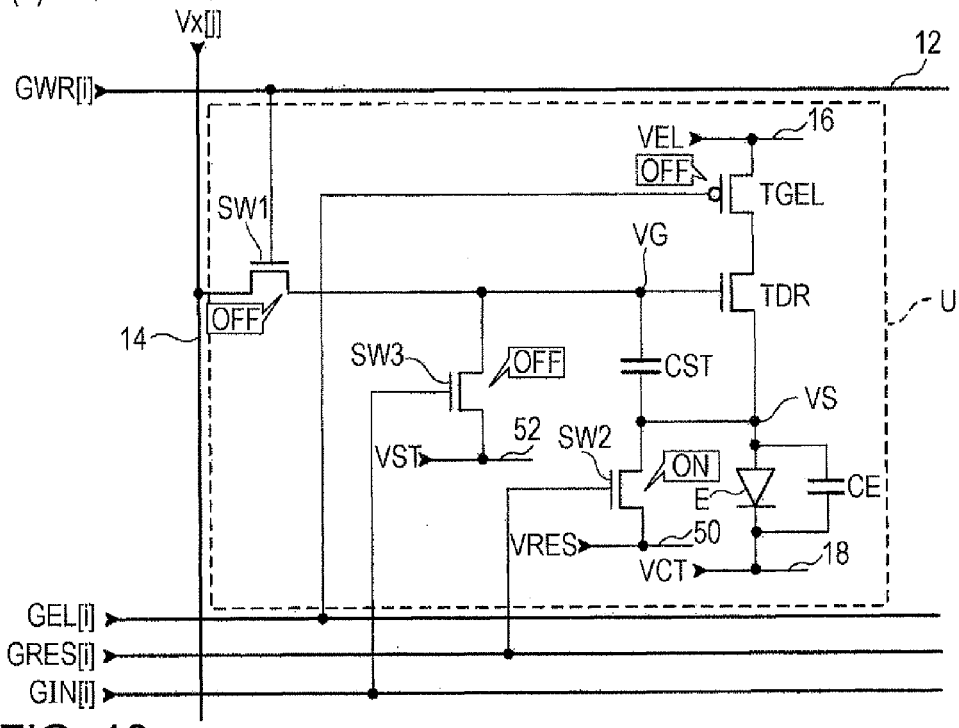
FIG. 9 is a diagram showing an action of the pixel circuit in a reset period.

As shown in FIG. 4, when the reset period Pr starts, the drive circuit 30 sets the scanning signal GWR[i] to the low level, whereas the reset signal GRES[i] and the light emitting control signal GEL[i] to the high level. Other signals are kept at the same level as in the writing period PWRT. Therefore, as shown in FIG. 9, the first switching device SW1 and the light emitting control transistor TGEL are transitionally turned off, whereas the second switching device SW2 is transitionally turned on.

In the reset period Pr, the transition of the second switching device SW2 to the on state allows the source of the driving transistor TDR and the reset line 50 to be conducted to each other. Therefore, the source potential VS of the driving transistor TDR is set to the reset potential VRES. As described above, the reset potential VRES is set to a value so that the voltage between both ends of the capacitance CE falls below the light emitting threshold voltage of the light emitting device E. Further, since the first switching device SW1 is transitionally turned off, the gate of the driving transistor TDR is made to be electrically floating. Therefore, while the voltage between both ends of the capacitive element CST is kept at the voltage VSET at the ending point of the writing period PWRT, the gate potential VG of the driving transistor TDR varies in conjunction with the source potential VS. A variation amount of the gate potential VG at this time is equal to that of the source potential VS.

e: Light Emitting Period PEL

Figure 10:
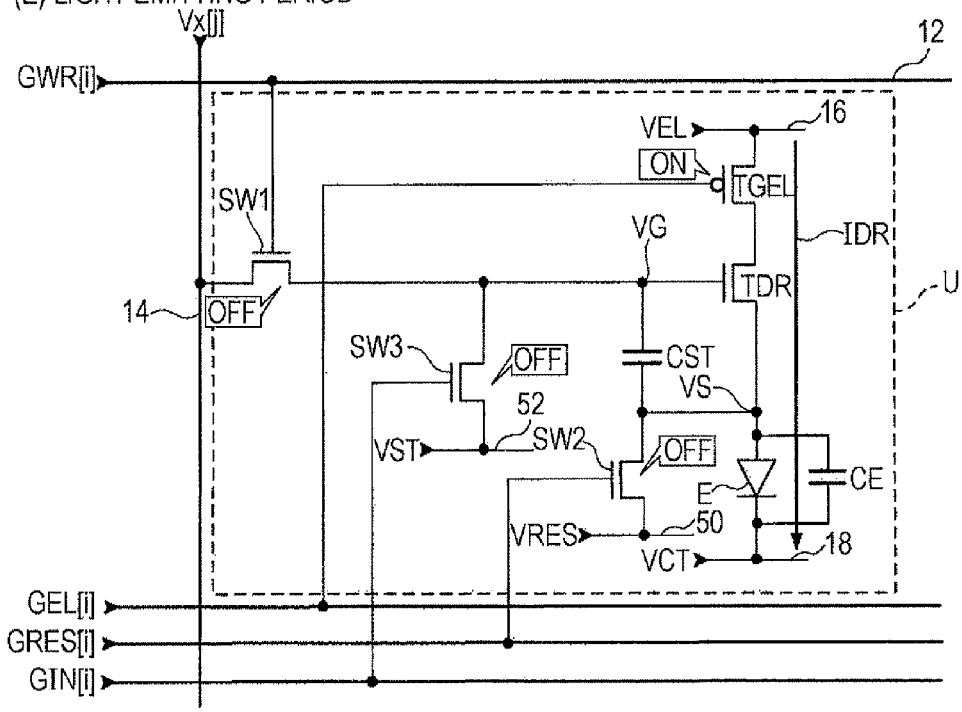
FIG. 10 is a diagram showing an action of the pixel circuit in a light emitting period.

As shown in FIG. 4, when the light emitting period PEL starts, the drive circuit 30 sets the reset signal GRES[i] and the light emitting control signal GEL [i] to the low level. Other signals are kept at the same level as in the reset period Pr. Therefore, as shown in FIG. 10, the second switching device SW2 is transitionally turned off, whereas the light emitting control transistor TGEL is transitionally turned on. The transition of the light emitting control transistor TGEL to the on state allows a route of the current to be formed, and the current IDS corresponding to the voltage VSET held by the capacitive element CST flows in the driving transistor TDR. This makes the source potential VS of the driving transistor TDR rise with time.

The gate of the driving transistor TDR is electrically floating also in the light emitting period PEL; thus, the gate potential VG of the driving transistor TDR rises in conjunction with the source potential VS. Then, while the voltage VGS between the gate and the source of the driving transistor TDR (voltage between both ends of the capacitive element CST) is kept at the voltage VSET set in the writing period PWRT, the voltage between both ends of the capacitance CE pertaining to the light emitting device E (the source potential VS of the driving transistor TDR) gradually increases. When the voltage between both ends of the capacitance CE reaches the light emitting threshold voltage of the light emitting device E, the current IDS corresponding to the voltage VSET (current not depending on the mobility μ and the threshold voltage VTH of the driving transistor TDR) flows in the light emitting device E as the driving current IDR. The light emitting device E emits light with a luminance corresponding to the current amount of the driving current IDR. The source potential VS of the driving transistor TDR at this time is kept at a predetermined value determined depending on the current amount of the driving current IDR and an on-resistance of the driving transistor TDR. The time length t shown in FIG. 4 represents a time length from a starting point of the light emitting period PEL to a point when the light emitting device E starts emitting light. The light emitting device E continues to emit light for a residual period in the light emitting period PEL.

The current amount of the driving current IDR supplied to the light emitting device E is determined depending on the time change rate RX of the data potential VX at the ending point te of the writing period PWRT. In the embodiment, the drive circuit 30 varies the data potential VX with time so that the time change rate RX of the data potential VX at the ending point te of the writing period PWRT (at the time when the supply of the data potential VX to the gate of the driving transistor TDR is stopped) is equal to the time change rate RX corresponding to the designated gradation of the pixel circuit U.

Here, the voltage VGS between the gate and the source of the driving transistor TDR (voltage VSET between both ends of the capacitive element CST) at the ending point of the writing period PWRT is automatically set depending on the properties such as the mobility μ and the threshold voltage VTH thereof so as to become a voltage which is required for the current EDS of formula (4) not depending on the mobility μ and the threshold voltage VTH to flow in the driving transistor TDR. However, the source potential VS of the driving transistor TDR at that time becomes a value depending on the mobility μ and the threshold voltage VTH of the driving transistor TDR, and the value is difficult to accurately grasp.

Consequently, in an aspect in which the reset period Pr is not provided (hereinafter, referred to as "comparative example") unlike the embodiment, the source potential VS of the driving transistor TDR at the starting point of the light emitting period PEL (at the ending point of the writing period PWRT) is difficult to accurately grasp. As described above, the time length t from the starting point of the light emitting period PEL until the point when the light emitting device E starts emitting light is determined depending on the source potential VS of the driving transistor TDR and the current IDS flowing in the driving transistor TDR at the starting point of the light emitting period PEL. However, if, as in the comparative example, the source potential VS of the driving transistor TDR at the starting point of the light emitting period PEL cannot be accurately grasped, AVb of formula (1) described above cannot be accurately grasped, and the time length t cannot be highly precisely set. As described above, if the time length t cannot be highly precisely set, a time length while the light emitting device E actually emits light in the light emitting period PEL cannot be highly precisely set, and thus, the time integral value of the light emission luminance of the light emitting device E cannot be set highly precisely. This disadvantageously makes it difficult to set the gradation of the pixel recognized by the observer to a desired value with high precision.

Further, in the comparative example, for example, assumed is a case where the designated gradation of the respective plurality of pixel circuits U is the same with one another. The source potential VS of each driving transistor TDR at the starting point of the light emitting period PEL has a value depending on the properties of the relevant driving transistor TDR; therefore, even if the designated gradation of the respective pixel circuits U is the same with one another, the source potential VS of the driving transistor TDR of each of the pixel circuits U varies every pixel circuit U. Therefore, the time length t from the starting point of the light emitting period PEL until the point when the light emitting device E starts emitting light varies every pixel circuit U, making it difficult to obtain a uniform light emission.

In contrast, in the embodiment, since the source potential of the driving transistor TDR is set to the reset potential VRES in the reset period Pr between the writing period PWRT and the light emitting period PEL, the source potential VS of the driving transistor TDR at the starting point of the light emitting period PEL is set to the reset potential VRES independently of the properties of the driving transistor TDR. Thus, by setting the reset potential VRES to a predetermined target value, the time length t from the starting point of the light emitting period PEL until the point when the light emitting device E starts emitting light can be set highly precisely. Therefore, the time length while the light emitting device E actually emits light in the light emitting period PEL can be highly precisely set, enabling to highly precisely set the time integral value of the light emission luminance of the light emitting device E. As a result, the gradation of the pixel recognized by the observer advantageously can be highly precisely set to a desired value. Note that the reset potential VRES can be arbitrarily set, and can be set to a value required for obtaining a desired time length t.

Furthermore, also in the case where the designated gradation of the plurality of pixel circuits U is the same with one another, the source potentials VS of the respective driving transistors TDR are set to the reset potential VRES at the starting point of the light emitting period PEL. Therefore, the time length t from the starting point of the light emitting period PEL until the point when the light emitting device E starts emitting light can be prevented from varying every pixel circuit U. This advantageously enables to obtain the uniform light emission.

C: Modifications

The invention is not limited to the above-described embodiment, and the following modifications may be made, for example. Moreover, two or more of the modifications described below may be combined.

1: Modification 1

In the above-described embodiment, the data potentials VX[1] to VX [n] output from the signal line drive circuit 34 to the respective signal lines 14 vary with time with a period of the unit period H. However, the aspect of the invention is not limited to the variation with time and may be that the data potentials VX[1] to VX[n] do not vary with time and have a constant value. In this aspect, in the compensation period PCP the compensation action is performed which makes the voltage VGS between the gate and the source of the driving transistor TDR asymptotically come close to the threshold voltage VTH of the driving transistor TDR, and thereafter, in the writing period PWRT a current corresponding to the data potential VX flows in the driving transistor TDR. This makes the source potential VS of the driving transistor TDR rise and a mobility compensation action by negative feedback be performed. Note that similarly to the above-described embodiment the source potential VS of the driving transistor TDR at the ending point of the writing period PWRT is set so that the voltage between both ends of the capacitance CE falls below the light emitting threshold voltage of the light emitting device E. That is, in this aspect also, the voltage VGS between the gate and the source of the driving transistor TDR (voltage between both ends of the capacitive element CST) at the ending point of the writing period PWRT is set to a value in which the data potential VX and the properties of the driving transistor TDR (threshold voltage VTH and mobility μ) are reflected.

In this aspect also, the source potential of the driving transistor TDR is set to the reset potential VRES for the reset period Pr between the writing period PWRT and the light emitting period PEL, making it possible to highly precisely set the time length t from the starting point of the light emitting period PEL until the point when the light emitting device E starts emitting light.

2: Modification 2

In the above-described embodiment, the compensation period PCP is provided immediately before the writing period PWRT. However, the aspect of the invention is not limited to the provision of the compensation period PCP and the compensation period PCP may not be provided in the aspect. This is because in this aspect, for example, if the time change rate RX[i,j] of the data potential VX[j] supplied to the signal line 14 of the jth column is set to a value corresponding to the designated gradation of the pixel circuit U positioned at the ith row and the jth column at the ending point of the writing period PWRT (unit period H[i]) while the scanning line 12 of the ith row is selected, the voltage VGS between the gate and the source of the driving transistor TDR in the pixel circuit U (voltage VSET between both ends of the capacitive element CST) is automatically set depending on the properties such as the mobility μ and the threshold voltage VTH thereof so as to become a voltage which is required for the current IDS of formula (4) to flow in the driving transistor TDR.

3: Modification 3

In the above embodiment, the light emitting control transistor TGEL is set to the off state for the reset period Pr. However, the aspect of the invention is not limited to the off state, and the light emitting control transistor TGEL may be set to the on state for the reset period Pr. According to the aspect as the above-described embodiment in which the light emitting control transistor TGEL is set to the off state for the reset period Pr, the current advantageously can be prevented from flowing in the driving transistor TDR.

4: Modification 4

The current amount of the driving current IDR supplied to the light emitting device E is determined depending on the time change rate RX of the data potential VX at the ending point te of the writing period PWRT. Therefore, it is preferably configured so that the time change rate RX of the data potential VX be determined depending on the designated gradation at the ending point te of the writing period PWRT (at the time when the supply of the data potential VX to the gate of the driving transistor TDR is stopped) of the data potentials VX, regardless of the waveform of the data potential VX (time change rate RX) in the middle of the writing period PWRT in the invention. However, in order to accurately match the time change rate RS of the source potential VS of the driving transistor TDR at the ending point te of the writing period PWRT to the time change rate RX of the data potential VX, a configuration is especially preferable in which the time change rate RX of the data potential VX be continuously fixed to a constant numerical value corresponding to the designated gradation over a predetermined time till the ending point te.

5: Modification 5

A conductivity type of each of the transistors (driving transistor TDR, light emitting control transistor TGEL, first switching device SW1 to third switching device SW3) constituting the pixel circuit U may be selected arbitrarily. For example, a configuration in which the driving transistor TDR is a P-channel type may be employed. In the case where the P-channel type driving transistor TDR is employed, the voltage relationship (high and low) is reversed, but the essential action is similar to FIG. 4 compared with the case where the N-channel type driving transistor TDR is employed. Thus, the description of the action thereof is omitted.

6: Modification 6

The light emitting device E may be an OLED device, or may be an inorganic light emitting diode or an LED (light emitting diode). In short, all devices which emit light in response to electrical energy supplied (application of electrical field or current supply) can be used for the light emitting device of the invention.

D: Application Example

Figure 11:
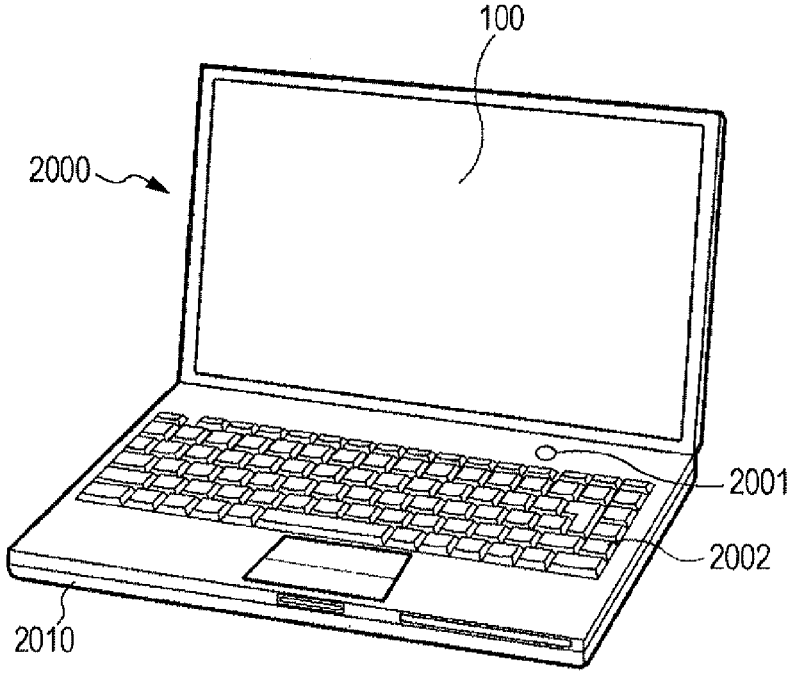
FIG. 11 is a perspective view of a specific example of an electronic apparatus according to an embodiment of the invention.

Next, a description is given of an electronic apparatus using the light emitting apparatus according to the invention. FIG. 11 is a perspective view showing a configuration of a mobile type personal computer employing the light emitting apparatus 100 according to the above-described embodiment as a display device. A personal computer 2000 includes a light emitting apparatus 100 as the display device and a main body 2010. The main body 2010 is provided with a power switch 2001 and a keyboard 2002. The light emitting apparatus 100, employing the OLED device as the light emitting device E, can display a screen easy to be viewed with a wide view angle.

Figure 12:
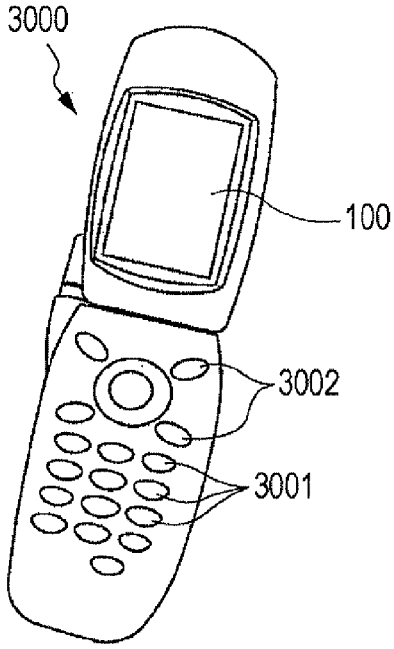
FIG. 12 is a perspective view of a specific example of the electronic apparatus according to another embodiment of the invention.

FIG. 12 shows a configuration of a cellular phone employing the light emitting apparatus 100 according to the above-described embodiment as a display device. The cellular phone 3000 includes a plurality of manual operation buttons 3001 and scroll buttons 3002, and the light emitting apparatus 100. By operating the scroll buttons 3002, a screen displayed on the light emitting apparatus 100 is scrolled.

Figure 13:
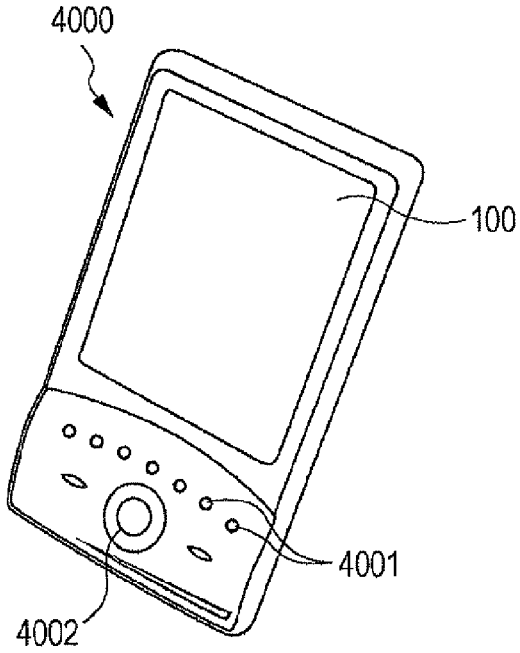
FIG. 13 is a perspective view of a specific example of the electronic apparatus according to another embodiment of the invention.
Figure 14:
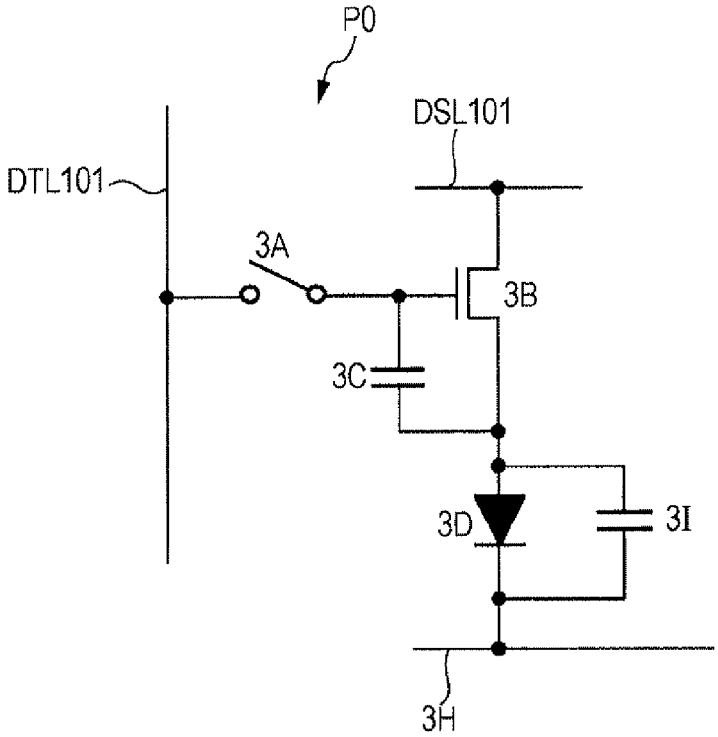
FIG. 14 is a circuit diagram of a pixel circuit in a light emitting apparatus of related art.

FIG. 13 shows a configuration of a personal digital assistant (PDA) employing the light emitting apparatus 100 according to the above-described embodiment as a display device. The personal digital assistant 4000 includes a plurality of manual operation buttons 4001 and a power switch 4002, and the light emitting apparatus 100. If the power switch 4002 is operated, various information such as an address list and a schedule is displayed on the light emitting apparatus 100.

Note that the electronic apparatus to which the light emitting apparatus according to the invention is adopted includes, besides those shown in FIGS. 11 to 13, a digital still camera, a television, a video camera, a car navigation system, a pager, an electronic data book, electronic paper, a calculator, a word processor, a workstation, a TV-telephone, a point-of-sale terminal, a printer, a scanner, a copier, a video player, an apparatus provided with a touch panel and the like.

What is claimed is:

1. A light emitting apparatus comprising:

a pixel circuit; and a drive circuit which drives the pixel circuit, wherein:

the pixel circuit includes:

a light emitting device;

a driving transistor connected in series to the light emitting device;

a capacitive element arranged between a gate and a source of the driving transistor;

a first switching device arranged between the gate of the driving transistor and a signal line corresponding to the pixel circuit; and a second switching device arranged between the source of the driving transistor and a reset line, and the drive circuit;

for a first period, sets the first switching device to be turned on and sets a potential to be supplied to the signal line to a data potential corresponding to designated gradation of the pixel circuit to flow a current according to the data potential in the driving transistor and sets a voltage between both ends of the capacitive element to a value in which the data potential and properties of the driving transistor are reflected;

for a second period after the first period, sets the first switching device to be turned off and sets the second switching device to be turned on to set a source potential of the driving transistor to a reset potential supplied to the reset line; and for a third period after the second period, sets the second switching device to be turned off to vary the source potential of the driving transistor so that the light emitting device emits light, wherein the driving transistor and the light emitting device are arranged between a first power line supplied with a first potential and a second power line supplied with a second potential, one of electrodes of the light emitting device is connected to the source of the driving transistor and the other electrode of the light emitting device is connected to the second power line, and a potential difference between the source potential of the driving transistor and the second potential for the first period and the second period is set so as to fall below a light emitting threshold voltage of the light emitting device, and the pixel circuit further includes:

a third switching device disposed between a node and an initialization line, the node being disposed between the gate of the driving transistor and the first switching device; and a light emitting control transistor arranged between the first power line and the second power line, and the drive circuit;

for an initialization period before the first period, sets the light emitting control transistor and the first switching device to be turned off, and sets the second switching device and the third switching device to be turned on so as to initialize the voltage between the gate and the source of the driving transistor, for a compensation period in the first period, sets the first switching device and the second switching device to be turned off, and sets the third switching device and the light emitting control transistor to be turned on so as to perform a compensation action which makes the voltage between the gate and the source of the driving transistor asymptotically come close to the light emitting threshold voltage, and for a writing period after the compensation period in the first period, sets the first switching device and the light emitting control transistor to be turned on, sets the second switching device and the third switching device to be turned off, and sets a potential to be supplied to the signal line to the data potential.

2. The light emitting apparatus according to claim 1, wherein the drive circuit sets the light emitting control transistor to be turned off for the second period, and sets the light emitting control transistor to be turned on for the third period.

3. An electronic apparatus comprising a light emitting apparatus according to claim 2.

4. The light emitting apparatus according to claim 1, wherein the drive circuit varies the data potential with time so that a time change rate of the data potential at a time when the first switching device is made to be turned off to stop the supply of the data potential to the driving transistor becomes a time change rate corresponding to the designated gradation.

5. The light emitting apparatus according to claim 4, wherein the voltage between both ends of the capacitive element is set so that a current corresponding to a product of the time change rate of the data potential at a time when stopping the supply of the data potential to the driving transistor and a capacitance value of a capacitance pertaining to the light emitting device flows in the driving transistor.

6. An electronic apparatus comprising a light emitting apparatus according to claim 4.

7. An electronic apparatus comprising a light emitting apparatus according to claim 5.

8. An electronic apparatus comprising a light emitting apparatus according to claim 1.

9. An electronic apparatus comprising a light emitting apparatus according to claim 1.

10. A method for driving a light emitting apparatus including a pixel circuit which has a light emitting device, a driving transistor connected in series to the light emitting device, a capacitive element arranged between a gate and a source of the driving transistor, a first switching device arranged between the gate of the driving transistor and a signal line corresponding to the pixel circuit, a second switching device arranged between the source of the driving transistor and a reset line, the driving transistor and the light emitting device are arranged between a first power line supplied with a first potential and a second power line supplied with a second potential, one of electrodes of the light emitting device is connected to the source of the driving transistor and the other electrode of the light emitting device is connected to the second power line, a potential difference between the source potential of the driving transistor and the second potential for the first period and the second period is set so as to fall below a light emitting threshold voltage of the light emitting device, a third switching device disposed between a node and an initialization line, the node being disposed between the gate of the driving transistor and the first switching device, and a light emitting control transistor arranged between the first power line and the second power line, the method comprising:

for a first period, setting a voltage between both ends of the capacitive element to a value in which a data potential and properties of the driving transistor are reflected by supplying the data potential corresponding to designated gradation of the pixel circuit to the gate of the driving transistor to flow a current corresponding to the data potential in the driving transistor;

for a second period after the first period, setting a source potential of the driving transistor to a reset potential supplied to the reset line;

for a third period after the second period, varying the source potential of the driving transistor so that the light emitting device emits light;

a potential difference between the source potential of the driving transistor and the second potential for the first period and the second period is set so as to fall below a light emitting threshold voltage of the light emitting device, for an initialization period before the first period, setting the light emitting control transistor and the first switching device to be turned off, and setting the second switching device and the third switching device to be turned on so as to initialize the voltage between the gate and the source of the driving transistor, for a compensation period in the first period, setting the first switching device and the second switching device to be turned off, and setting the third switching device and the light emitting control transistor to be turned on so as to perform a compensation action which makes the voltage between the gate and the source of the driving transistor asymptotically come close to the light emitting threshold voltage, and for a writing period after the compensation period in the first period, setting the first switching device and the light emitting control transistor to be turned on, setting the second switching device and the third switching device to be turned off, and setting a potential to be supplied to the signal line to the data potential.

11. The method for driving a light emitting apparatus according to claim 10, wherein the data potential is varied with time so that a time change rate of the data potential at a time when a first switching device is made to be turned off to stop the supply of the data potential to the driving transistor becomes a time change rate corresponding to the designated gradation.

* * * * *